United States Patent [19]

Richards et al.

[11] 4,416,690

[45] Nov. 22, 1983

[54] SOLID MATTE-OXYGEN CONVERTING PROCESS

[75] Inventors: Kenneth J. Richards; David B. George, both of Salt Lake County, Utah

[73] Assignee: Kennecott Corporation, Cleveland, Ohio

[21] Appl. No.: 268,765

[22] Filed: Jun. 1, 1981

[51] Int. Cl.[3] ..... C22B 15/06

[52] U.S. Cl. ..... 75/26; 75/73; 75/75

[58] Field of Search ..... 75/72, 73, 74, 75, 26, 75/92

[56] References Cited

U.S. PATENT DOCUMENTS

| | | | |
|---|---|---|---|
| 8,599 | 12/1851 | Tracy | 75/72 |
| 47,407 | 4/1865 | Faber | 75/72 |
| 532,809 | 1/1895 | Nicholls et al. | 75/72 |
| 826,099 | 7/1906 | Gilman | 75/72 |
| 832,738 | 10/1906 | Kemp | 75/75 |
| 957,231 | 5/1910 | Maschmeyer | 75/72 |
| 1,542,935 | 6/1925 | Greenawalt | 75/72 |
| 2,668,107 | 2/1954 | Gordon et al. | 75/74 |
| 3,459,415 | 8/1969 | Holeczy et al. | 75/73 |
| 3,527,449 | 9/1970 | Worner | 75/92 |
| 3,892,560 | 7/1975 | Nermes et al. | 75/74 |
| 3,948,639 | 4/1976 | Nermes et al. | 75/74 X |
| 4,155,749 | 5/1979 | Jaquay | 75/75 |

OTHER PUBLICATIONS

Healy, G. W., Instrument Society of America, Annual Conf. 1977, pp. 45–48.

Harkki et al., *TMS-AIME Paper A74-16*, The Metallurgical Society of AIME, 1974, pp. 1–18.

*Primary Examiner*—M. J. Andrews

*Attorney, Agent, or Firm*—Gary R. Plotecher; Herbert D. Knudsen; Larry W. Evans

[57] ABSTRACT

Copper sulfide ores are processed by a unique series of steps to produce blister copper, while attaining long sought advantages. An initial smelting step is carried out in any desired manner, e.g. according to conventional practice, to produce a molten, copper sulfide matte or white metal. This matte or white metal is then solidified and subjected to a size-reduction step to produce solid particles capable of being injected into a converting vessel in a stream of oxygen, either pure oxygen or air significantly enriched with oxygen. With the matte or white metal injected in this manner, the converting reaction may be carried out on an autogenous basis, with continuous evolution of substantially undiluted $SO_2$ gas capable of being liquified for use in the production of elemental sulfur or sulfuric acid or for disposal so as to avoid atmospheric contamination. The usual fugitive gas emissions resulting from the handing and transporting of molten matte in conventional ways are almost completely avoided, and continuous optimized operation of the converting vessel is achieved independently of operation of the smelting step, making it possible to eliminate the often-resorted-to close coupling of smelting and converting furnaces and affording unusual freedom in plant layout.

17 Claims, 1 Drawing Figure

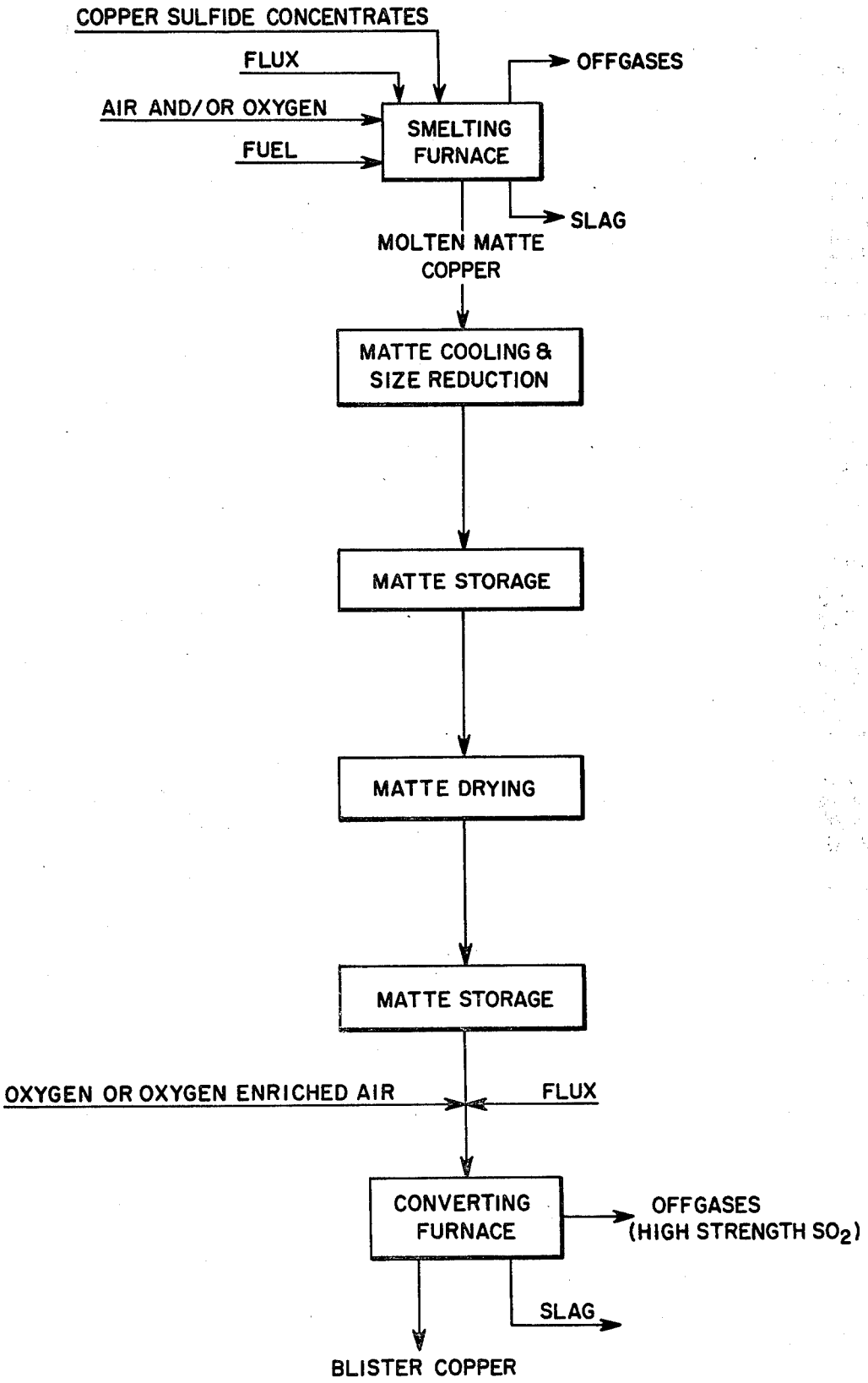
COPPER SULFIDE CONCENTRATES
FLUX
AIR AND/OR OXYGEN
FUEL
SMELTING FURNACE
OFFGASES
SLAG
MOLTEN MATTE COPPER
MATTE COOLING & SIZE REDUCTION
MATTE STORAGE
MATTE DRYING
MATTE STORAGE
OXYGEN OR OXYGEN ENRICHED AIR
FLUX
CONVERTING FURNACE
OFFGASES (HIGH STRENGTH $SO_2$)
SLAG
BLISTER COPPER

SOLID MATTE-OXYGEN CONVERTING PROCESS

BACKROUND OF THE INVENTION

1. Field

The invention has to do with the production of blister copper from a copper sulfide ore material, and is concerned with the handling of a copper matte or a similar sulfide material, such as white metal, from a smelting step through a converting step.

2. State of the Art

The usual way of producing blister copper is to discharge molten matte from a smelting vessel, such as a reverberatory furnace or a flash smelting furnace, into a ladle and transport it to a converter. The matte is fed into the converter in its molten state to enable air to be blown therethrough from tuyeres submerged in the matte. In the converter, air is blown through the molten matte, oxidizing the iron and sulfur therein to produce an iron-containing slag and sulfur dioxide gas. The end product of the converting step is blister copper. During the transport of molten matte in ladles, there is an unavoidable loss of sulfur oxide gases which pollute the working atmosphere of the plant. No effective way has been found to control such fugitive gases from a ladle. Another serious source of fugitive emissions is from around the converter itself. Since converters are rotating furnaces, the connections between them and gas-handling flues are mechanically complex and difficult to maintain gas tight. Emissions from around the converter can be collected and treated to remove sulfur oxides, but the means for doing so are mechanically complex and expensive to build and operate.

Close coupling of smelting and converting furnaces has been resorted to for the purpose of controlling fugitive gases so far as possible. Thus, launders or chutes covered by fume-catching hoods, have been employed for passing the molten matte from smelting furnaces to close-coupled converting furnaces. Unfortunately, however, control of such close-coupled furnaces is difficult, and mechanical failure in any portion of the system forces shut down of the entire system during repair.

There have been many proposals and a few actual attempts to carry out both smelting and converting in a single, continuous operation, but, so far, all such attempts have either proven impractical from a commercial standpoint or have suffered various disadvantages weighed against their replacing conventional smelting and converting in separate furnaces.

It has been recognized heretofore that molten matte can be solidified and put through a size-reducing operation in preparation for further treatment. Historically, further treatment has included roasting of the finely divided matte solids, followed by leaching of the roasted matte. Again, copper sulfide matte solids have been roasted or calcined to produce copper oxide solids, which have then been melted in a furnace, with or without a minor portion of copper sulfide matte solids, to produce molten blister copper and a slag. Such practices have long given way to the usual converting, in a standard converter vessel, of molten copper sulfide matte from a smelting operation, such as in a reverberatory furnace or a flash smelting furnace.

Comparatively recent work by Outokumpu Oy in Finland with a so-called "oxidation-reduction process" (Nermes et al. U.S. Pat. Nos. 3,892,560 and 3,948,639) has utilized the roasting of a granulated copper sulfide matte and/or a granulated iron sulfide matte to produce hot roasting gases for feeding into the reaction zone of a flash smelting furnace to control the relationship between oxidation capacity and smelting capacity in a flash smelting process. Blister copper is not a product of that Finnish process, although it is claimed in more recent literature that blister copper can be produced in a single flash smelting furnace as a product of continuous operation thereof in a combined smelting and converting procedure by controlling reactions in the furnace to effect both smelting and converting. This, of course, contemplates copper sulfide concentrates as the feed material to the flash smelting furnace, and suffers, as do all combined smelting and converting processes carried out in a single furnace, by the fact that metallic copper present within the furnace preferentially absorbs impurities, such as arsenic, bismuth, and antimony from the furnace feed. These impurities are carred over into the blister copper. Also, in many instances, there are large quantities of slag having a high copper content which must be further processed to recover the copper.

SUMMARY OF THE INVENTION

In accordance with the process of this invention, copper sulfide concentrates or other copper sulfide ore material is smelted in any of the usual ways to produce a molten matte or similar sulfide material such as white metal (hereinafter spoken of only as "matte") of the type normally fed directly into a converter furnace for the production of blister copper. However, instead of following the normal practice, in accordance with the present invention the molten material is formed into fine particles of solidified matte either by granulation, atomization and solidification of the resulting droplets, or solidification followed by crushing and grinding into a particle size adapted for feeding into a converting furnace, for example, a flash smelting furnace. This permits wide latitude in the handling of the matte prior to the converting step and eliminates the usual concern for fugitive gases. Moreover, it enables plant layout to be made in the most advantageous manner under all the circumstances existing at any given plant site, since there is no requirement for close coupling of smelting and converting furnaces from either a space or an operating standpoint. The solid particles of matte are fed into the converting furnace along with an appropriate amount of flux in a similar way to that in which copper sulfide concentrates are fed into a smelting furnace, i.e. by means of an oxygen-rich carrier gas. As a result, converting of the matte takes place with the generation of unusually high-strength $SO_2$ gas, which is easily collected and can be used in the production of sulfuric acid or elemental sulfur. Molten blister copper of a purity substantially that produced by conventional copper converting is produced as a product of the converting furnace, along with an appropriate amount of slag. Although some heat is lost in the solidification of the molten matte, it has been found, surprisingly, that the heat generated while oxidizing the sulfur and iron in the solidified matte is sufficient to provide substantially all the heat required to remelt the solidified material. Further, the cold matte allows the use of substantially pure oxygen or highly oxygen enriched air in the converting furnace, usually without the danger of overheating. This, in turn, maximizes the $SO_2$ gas strength obtained from the furnace.

THE DRAWING

An embodiment of the invention constituting the best mode presently contemplated of carrying the process out in actual practice is illustrated in the accompanying drawing wherein the single figure is a flow sheet showing preferred procedures.

DETAILED DESCRIPTION OF THE ILLUSTRATED EMBODIMENT

Smelting of a copper sulfide material, usually copper sulfide flotation concentrates, may be carried out in any suitable manner and equipment, such as the manner indicated wherein copper sulfide concentrates and a flux are introduced into a smelting furnace, typically the usual reverbatory furnace which is fired by the introduction of fuel and air and/or oxygen by means of a usual burner and from which slag is tapped periodically and off-gases are conducted to waste or for use.

A molten copper sulfide material, which may be white metal or the like but is typically copper sulfide matte, is withdrawn from the furnace and handled in any convenient manner for solidification and size reduction. Any practical means may be employed to produce finely divided solid particles of the withdrawn molten matte. Such molten matte may be granulated by discharge into water or may be atomized in fine droplet form and solidified directly as fine particles, or it may be poured into a suitable vessel or onto a suitable surface for cooling, and, when solidified, broken, crushed, and ground into finely-divided, particle form utilizing standard crushing and grinding equipment for the purpose.

The matte contains copper, iron, sulfur, and varying quantities of minor metallic and non-metallic constituents. As placed in finely-divided, particle form, it is usually stored for subsequent use in the process, since it is desirable to have an adequate supply in reserve to draw from in feeding, on a continuous and efficient basis, a converting furnace for the production of blister copper.

As illustrated, it is advantageous to first store the finely-divided particles of matte for feeding to a drying step, which may be carried out in any suitable equipment such as a rotary drier, fluid bed drier, flash drier, etc. The dried material, usually having moisture content of less than 3% by weight and often within the range of 0.1 to 0.2% or less, is then stored in a second storage facility for direct feeding, along with pure oxygen or oxygen-enriched air and a flux, to a converter furnace.

The converter furnace may be of any type wherein melting of the solid matte and the required converting reaction take place. It is presently considered preferable to utilize a so-called "flash smelting" type of furnace wherein the solid matte and flux are suspended in a stream of pure oxygen or of oxygen-enriched air and introduced into an initially pre-heated furnace, the converting reaction continuing on an autogenous basis. However, the suspension stream could be introduced into a molten bath of matte by means of a conventional oxygen lance modified to accept the solid particles.

Blister copper is withdrawn from the converter furnace as a final product of the process, and an unusually high-strength $SO_2$ gas is continuously drawn off for conversion to sulfuric acid in the usual manner or for other disposition as may be found desirable. Slag is withdrawn in customary manner and may be recycled if desired.

When essentially pure oxygen gas is utilized, sufficient heat is produced to satisfy the thermal requirements of the process, i.e. the melting of the solid matte, the forming of the slag and blister copper, and the supplying of sufficient heat to maintain furnace operating temperature and to substantially offset heat losses from the furnace. In some applications of the process, there may be more heat generated than needed to satisfy the thermal requirements. It has been found that the lower the copper content of the feed matte, the greater the quantity of heat in excess of the normal thermal requirements indicated above. Similarly, as the throughput capacity of the converting furnace is increased, the quantity of heat lost through the walls, roof, and bottom of the furnace becomes a proportionally smaller amount of the heat generated per ton of matte processed. It follows that a large capacity furnace will have more heat in excess of that required by the process than will a smaller capacity furnace, given the same matte composition and oxidant gas composition.

It has been found that, by controlling the grade of the feed matte and the oxygen content of the oxidant gas, substantially greater quantities of so-called "inert" copper-bearing materials can be treated in addition to the matte feed. These "inert" coolant materials effectively utilize the excess heat from oxidation of the matte to melt them. The criterion for selecting these "inert" coolant materials is that they must require more heat to melt them and form slags from their slag-making constituents than will be generated from the oxidation of any sulfur, iron, or other elements present in such material in an oxidized form. Examples of "inert" materials which meet this criterion include but are not limited to the following: precipitate or cement copper, copper-rich flue dusts, copper-bearing concentrates derived from the treatment of copper-bearing slags, copper residues from hydrometallurgical processes, and copper-rich oxide slags.

There are other techniques that can be used to allow operation of the process without overheating the furnace while treating a matte which produces heat in excess of the normal thermal requirements. One effective technique is to introduce a fine spray of water into the furnace. The water injection rate is selected so that the heat required to evaporate the water is equal to the excess heat produced in the converter. The water vapor is exhausted from the furnace along with the sulfur dioxide gas generated by the converting operation. Alternatively, sulfur dioxide in either gaseous or liquid form may be introduced into the converting vessel during the converting operation and heated to operation temperature before exhaust from the converting vessel.

Another effective technique to control the excess heat in the converter is to cool the converter slag and return a portion of it to the converter. The slag remelts, consuming some of the excess heat and serving as an inert coolant.

Besides enabling most convenient and efficient placement of smelting and converting facilities in any given plant, the invention also provides for treating mattes derived from two or more smelting furnaces, and these mattes may have different compositions. The finely-divided, solid mattes from the different smelting furnaces can be blended to produce a single, converting-furnace feed, which is treated as a unitary composition input to the process. This allows great freedom in the placement and operation of the converter. It is also possible, for the first time, to have a central converting plant supplied with matte from one or more smelting furnaces at remote locations. This provides for heretofore unobtainable economic advantages by means of ideal placement of copper smelting and converting facilities.

We have conducted a number of small scale tests to obtain data indicative of process operability. These are summarized in the following example:

EXAMPLE 1

Solid copper matte containing 76% Cu, 2.6% Fe, and 20.4% S was crushed and ground to a size in which all particles passed through a 325 mesh size, standard, Tyler screen. The matte was placed in a device used for feeding at a controlled rate. This equipment consisted of a pressure-tight hopper with variable-speed screw feeder. The discharge from the screw feeder dropped into an aspirator, where the oxygen and matte were mixed. The mixture was transported to the test furnace through a flexible hose ⅜ of an inch in inside diameter and was introduced into the test furnace through a 10 inch long axial burner 2 inches in diameter inserted through the roof of the test furnace. The test furnace was a refractory lined, cylindrical vessel having an inside diameter of 24 inches and an inside height of 35 inches. The furnace was lined with chrome oxide-magnesium oxide refractory 6 inches thick.

Tests were conduced by first heating the cold furnace to an operating temperature of 2300° to 2500° F. using an oxygen-fuel burner. This burner was removed after pre-heating the furnace, and was replaced by an oxygen burner into which the finely divided solid matte was fed. The matte was fed at the rate of 45.6 lb per hour into a stream of pure oxygen flowing 2.0 standard cubic feet per minute. When the matte-oxygen mixture entered the furnace, a stable flame of burning matte was established.

Gas samples were extracted from the flame and they indicated essentially 100% utilization of the oxygen. The typical flame product gases contained:

$SO_2$: 81%
$O_2$: 2%
$N_2$: 12%
$CO_2$: 1.5%

The nitrogen in the gas samples was from the unavoidable dilution of furnace gases with air and is typical of small test furnaces.

The flame temperature exceeded 2800° F., the limit of the measuring device employed.

Products from the flame were collected on a cooled sampler and examined under the microscope. The products consisted primarily of copper metal with minor amounts of copper oxide and copper sulfide.

EXAMPLE 2

A typical application of the process in actual commercial practice, making use of a specific material and heat balance for illustrative purposes, is visualized as follows, but should not be regarded as limiting applicability of the process:

Blister copper from solid matte is produced continuously pursuant to the invention from a copper sulfide matte obtained by smelting copper sulfide concentrates in conventional manner. For this example, the smelting furnace is considered to be a commercial Noranda reactor treating, by the Noranda matte process, 1420 short tons per day of copper concentrates containing 26.4% copper, 26.7% iron, 31.0% sulfur, and 14% other constituents.

The matte is tapped from the Noranda reactor as a liquid at approximately 2150° F. in conventional manner. Instead of being transported by hot metal ladle to a conventional Peirce-Smith converter, as is normally done, the matte is cooled by granulating it in a stream of water. It should be noted that granulation of molten matte, in preparation for hydrometallurgical processing, is a well-known art. In this example, the cold granulated matte is conveyed to a ball mill, where its size is reduced so all of it is smaller than 65 mesh on the Tyler screen size system. The finely divided matte is then dried to remove essentially all free moisture, the residual moisture content being within the afore-mentioned range of 0.1 to 0.2% on a natural weight basis.

The dried matte is transported to one or more dry feed bins for storage ahead of the solid matte-oxygen converting furnace.

The converting process is initiated by first heating the converting furnace to its normal operating temperature of 2100° to 2500° F., using conventional fuel burners. When the furnace reaches its operating temperature, the conventional burners are removed and the matte-oxygen burners installed in their place.

Matte is withdrawn from the feed bins at a closely controlled rate. Flux for the converting furnace, preferably dry and finely ground limestone, is added to the matte in a proportion dictated by the iron and other minor constituent contents of the matte. In this example, every ton of matte requires 0.025 tons of limestone flux containing 52% CaO. The matte and flux mixture is conveyed to the matte-oxygen burners, where essentially pure oxygen is mixed with the feed. The resulting oxygen and matte mixture is blown into the furnace, where it ignites. The matte burns to form copper metal, slag, and sulfur dioxide gas. Molten droplets of copper and slag fall into the molten bath at the bottom of the furnace and separate into two phases.

The flow of oxygen is controlled as a function of both the matte feed rate and its composition, to yield copper of the desired sulfur and oxygen content.

The limestone flux combines with the iron in the matte and a small amount of copper to form a fluid slag. The heat released from matte combustion is sufficient to melt solid matte particles of the feed, to form the slag, and to offset the normal heat losses from the furnace refractories.

A mass balance for this example is given as follows:

| | | Percentages | | | | |
|---|---|---|---|---|---|---|
| | tpd | Cu | Fe | S | CaO | $CO_2$ |
| Input | | | | | | |
| Matte Feed | 503 | 75 | 2.6 | 20.4 | — | — |
| Flux | 12.4 | 0 | 0 | 0 | 052 | 44 |
| Oxygen | 106 | — | — | — | — | — |
| Output | | | | | | |
| Blister Copper | 372 | 99.5 | 0.0 | 0.50 | — | — |
| Slag | 33 | 15 | 30.3 | 0.0 | 15.0 | — |
| Offgas | 206 | — | — | 48.8 | — | 3.2 |

The offgas volume and composition expressed in more conventional units is 1651 standard cubic feet per minute containing 94.8% $SO_2$, 0.4%$N_2$, 1.6% $H_2O$, and 3.2% $CO_2$. The process is fully autogenous in this example, but it can be operated over a broad range of thermal conditions.

Whereas the process is here described with respect to a specific procedure presently regarded as the best mode of carrying out the invention, it is to be understood that various changes may be made and other procedures adopted without departing from the broader inventive concepts disclosed herein and comprehended by the claims that follow.

We claim:

1. An autogenous process for the conversion of particles of solid copper matte to blister copper comprising:

(a) heating a conversion reaction vessel to a temperature at which the conversion reaction takes place, (b) feeding sufficient quantities of particles of solid copper matte, oxygen and flux to the heated vessel such that the matte fed is converted and the principal source of heat for the continued operation of the conversion reaction is the oxidation of iron and sulfur in the matte fed, and (c) withdrawing liquid blister copper, liquid slag and $SO_2$ gas from the vessel.

2. The process of claim 1 wherein the oxidation of the iron and sulfur in the matte fed provides substantially all the heat for the operation of the conversion reaction.

3. The process of claim 1 wherein the oxidation of iron and sulfur in the matte fed provides sufficient heat to melt the particles, sustain the conversion reaction and compensate for heat losses of the vessel.

4. The process of claim 1 where the particles of matte are finely divided.

5. The process of claim 1 where the oxygen is introduced into the vessel as oxygen-enriched air or as substantially pure oxygen.

6. The process of claim 5 where the particles of matte and oxygen are fed to the vessel in separate streams.

7. The process of claim 5 where the fine particles of the matte are suspended in oxygen and fed to the vessel as an intimate mixture.

8. The process of claim 7 where the vessel is partially filled by a bath of molten material and where the particles and oxygen are introduced into a space within the vessel above the top surface of the bath such that at least a part of the conversion reaction occurs within the space.

9. The process of claim 5 where the vessel is partially filled by a bath of molten material and where the oxygen is fed into the bath of molten material and the particles are fed into the space within the vessel above the top surface of the bath.

10. The process of claim 5 where the vessel is partially filled by a bath of molten material and where the particles and oxygen are introduced into a bath of molten material.

11. The process of claim 1 where the particles are formed by:

(a) smelting a copper sulfide ore material to form a molten copper matte, (b) cooling the molten copper matte to form a solid copper matte, and (c) forming particles from the solid copper matte.

12. The process of claim 11 where step (b) is accomplished by discharging the molten matte produced in (a) into water and thereby forming granulated copper matte.

13. The process of claim 1 wherein the oxidation of iron and sulfur in the matte fed provides heat in excess of that necessary to melt the particles, sustain the conversion reaction and compensate for heat losses of the vessel.

14. The process of claim 13 where the excess heat is removed by adding to the vessel a net heat-consuming copper bearing material.

15. The process of claim 14 where the net heat-consuming copper bearing material is selected from the group consisting of precipitate or cement copper, copper-rich flue dust, copper-bearing concentrates derived from the treatment of copper-bearing slags, copper residues from hydrometallurgical processes, copper-rich oxide slags, and mixtures thereof.

16. The process of claim 13 where the excess heat is removed by adding to the vessel water or $SO_2$.

17. An autogenous process for preparing blister copper from particles of solid copper matte comprising:

(a) preparing fine particles of solid copper matte by smelting a copper sulfide ore material to form a molten copper matte, discharging the molten copper matte into water to form granulated copper matte, drying the granulated copper matte, and reducing the size of the granulated copper matte to form fine particles of the solid copper matte;

(b) heating a conversion reaction vessel to a temperature at which the conversion reaction takes place;

(c) feeding sufficient quantities of (1) the fine particles of solid copper matte suspended in substantially pure oxygen, and (2) flux to the heated vessel such that the matte fed ignites and is converted and the oxidation of the iron and sulfur in the matte fed provides sufficient heat to at least melt the particles, sustain the conversion reaction and compensate for heat losses of the vessel; and (d) withdrawing molten blister copper, liquid slag and high-strength $SO_2$ gas from the vessel.

* * * * *